US010007209B2

(12) United States Patent
Koshizuka et al.

(10) Patent No.: US 10,007,209 B2
(45) Date of Patent: Jun. 26, 2018

(54) DEVELOPING DEVICE AND IMAGE FORMING APPARATUS INCORPORATING SAME THAT REDUCE LOW-FLOW REGIONS OF TONER WITHIN THE DEVELOPING DEVICE

(71) Applicants: Shinnosuke Koshizuka, Kanagawa (JP); Koichi Yamazaki, Kanagawa (JP); Nobuo Takami, Kanagawa (JP); Atsushi Nakamoto, Kanagawa (JP); Kazunori Suzuki, Kanagawa (JP); Naohiro Kawashima, Kanagawa (JP)

(72) Inventors: Shinnosuke Koshizuka, Kanagawa (JP); Koichi Yamazaki, Kanagawa (JP); Nobuo Takami, Kanagawa (JP); Atsushi Nakamoto, Kanagawa (JP); Kazunori Suzuki, Kanagawa (JP); Naohiro Kawashima, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days. days.

(21) Appl. No.: 15/604,235

(22) Filed: May 24, 2017

(65) Prior Publication Data

US 2017/0351195 A1 Dec. 7, 2017

(30) Foreign Application Priority Data

Jun. 3, 2016 (JP) ..... 2016-111565

(51) Int. Cl.
*G03G 15/08* (2006.01)
*G03G 15/09* (2006.01)

(52) U.S. Cl.
CPC ..... *G03G 15/0812* (2013.01); *G03G 15/081* (2013.01); *G03G 15/0921* (2013.01)

(58) Field of Classification Search
CPC ..... G03G 15/081; G03G 15/0812; G03G 15/0921
(Continued)

(56) References Cited

U.S. PATENT DOCUMENTS 4,887,131 A * 12/1989 Kinoshita ..... G03G 15/09 399/275
6,522,855 B1 2/2003 Shunji et al.
(Continued)

FOREIGN PATENT DOCUMENTS

EP 2653929 A2 * 10/2013 ..... G03G 15/0812
JP 2001-092249 4/2001
(Continued)

*Primary Examiner* — Robert Beatty
(74) *Attorney, Agent, or Firm* — Duft Bornsen & Fettig LLP

(57) ABSTRACT

A developing device includes a developer bearer, a developer regulator disposed opposite the developer bearer across a first gap, and an opposing member having an opposing face disposed opposing the developer bearer across a second gap wider than the first gap. The opposing face is disposed adjacent to and upstream from the developer regulator in a direction of rotation of the developer bearer. The opposing face is inclined relative to an orthogonal plane direction orthogonal to a side face of the developer regulator. The opposing face is inclined to progressively reduce a distance from the developer bearer to the opposing face in a direction of rotation of the developer bearer. A difference between the second gap and the first gap is not greater than 1.75 times as large as the first gap.

14 Claims, 7 Drawing Sheets

(58) Field of Classification Search
USPC ..... 399/274, 275, 284
See application file for complete search history.

(56) References Cited

U.S. PATENT DOCUMENTS

| | | | | |
|---|---|---|---|---|
| 7,406,280 | B2 * | 7/2008 | Tomita | G03G 15/081 399/274 |
| 8,843,019 | B2 * | 9/2014 | Yoshizawa | G03G 15/0812 399/102 |
| 9,207,568 | B2 * | 12/2015 | Lee | G03G 15/0812 |
| 2003/0072591 | A1 * | 4/2003 | Sugihara | B82Y 15/00 399/267 |
| 2005/0185974 | A1 | 8/2005 | Terai | |
| 2008/0181676 | A1 * | 7/2008 | Yamagishi | G03G 15/0812 399/275 |
| 2008/0298848 | A1 * | 12/2008 | Lee | G03G 15/0812 399/274 |
| 2011/0129262 | A1 | 6/2011 | Nakamoto | |
| 2011/0217085 | A1 | 9/2011 | Hattori et al. | |
| 2012/0051797 | A1 | 3/2012 | Suzuki et al. | |
| 2012/0163874 | A1 | 6/2012 | Hattori et al. | |
| 2012/0219326 | A1 | 8/2012 | Koike et al. | |
| 2013/0034368 | A1 | 2/2013 | Hattori et al. | |
| 2013/0315636 | A1 | 11/2013 | Takayama et al. | |
| 2014/0003843 | A1 | 1/2014 | Suzuki et al. | |
| 2014/0376951 | A1 | 12/2014 | Ogawa et al. | |
| 2015/0023700 | A1 | 1/2015 | Nakamoto et al. | |
| 2016/0070208 | A1 | 3/2016 | Kikuchi et al. | |
| 2016/0195846 | A1 | 7/2016 | Koshizuka et al. | |
| 2017/0115597 | A1 | 4/2017 | Kawashima et al. | |

FOREIGN PATENT DOCUMENTS

| | | | | |
|---|---|---|---|---|
| JP | 2001215794 | A * | 8/2001 | |
| JP | 2005-092061 | | 4/2005 | |
| JP | 2005-215049 | | 8/2005 | |
| JP | 2010266674 | A * | 11/2010 | |
| JP | 2012027414 | A * | 2/2012 | |
| JP | 2012037893 | A * | 2/2012 | G03G 15/0812 |
| JP | 2012-047901 | | 3/2012 | |
| JP | 2012155008 | A * | 8/2012 | |

* cited by examiner

DEVELOPING DEVICE AND IMAGE FORMING APPARATUS INCORPORATING SAME THAT REDUCE LOW-FLOW REGIONS OF TONER WITHIN THE DEVELOPING DEVICE

CROSS-REFERENCE TO RELATED APPLICATIONS

This patent application is based on and claims priority pursuant to 35 U.S.C. § 119(a) to Japanese Patent Application No. 2016-111565, filed on Jun. 3, 2016, in the Japan Patent Office, the entire disclosure of which is hereby incorporated by reference herein.

BACKGROUND

Technical Field

Embodiments according to this disclosure generally relate to a developing device and an image forming apparatus, such as a copier, a printer, a facsimile machine, or a multifunction peripheral having at least two of copying, printing, facsimile transmission, plotting, and scanning capabilities, that includes the developing device.

Description of the Related Art

There are developing devices that include a developer bearer to bear developer and supply the developer to a latent image on a latent image bearer and a developer regulator to regulate the thickness of a layer of developer borne on the developer bearer.

For example, the developer bearer is a developing roller including a hollow developing sleeve that rotates, and a magnet body disposed inside the developing sleeve not to rotate together with the developing sleeve. The magnet body has a plurality of magnetic poles arranged in the direction in which the developing sleeve rotates. The magnet body exerts a magnetic force to attract developer including toner and magnetic carrier to the surface of the rotating developing sleeve, and the developer moves together with the developing sleeve. Alter the developer regulator regulates the thickness of a layer of developer on the developing sleeve, the developer is conveyed to a developing range opposite the latent image bearer (e.g., a photoconductor).

SUMMARY

According to an embodiment of this disclosure, a developing device includes a developer bearer to bear developer and supply the developer to a latent image on a latent image bearer, a developer regulator disposed opposite the developer bearer across a first gap to regulate a layer thickness of the developer borne on the developer bearer, and an opposing member having an opposing face disposed opposing the developer bearer across a second gap. The opposing face is disposed adjacent to and upstream from the developer regulator in a direction of rotation of the developer bearer. The opposing face is inclined relative to an orthogonal plane direction orthogonal to a side face of the developer regulator. The opposing face is inclined to progressively reduce a distance from the developer bearer to the opposing face as a position on the opposing face shifts from an upstream side to a downstream side in a direction of rotation of the developer bearer. The first gap is narrower than the second gap, and a difference between the second gap and the first gap is not greater than 1.75 times as large as the first gap.

According to another embodiment, an image forming apparatus includes the latent image bearer to bear a latent image, and the developing device described above, to develop the latent image with the developer.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
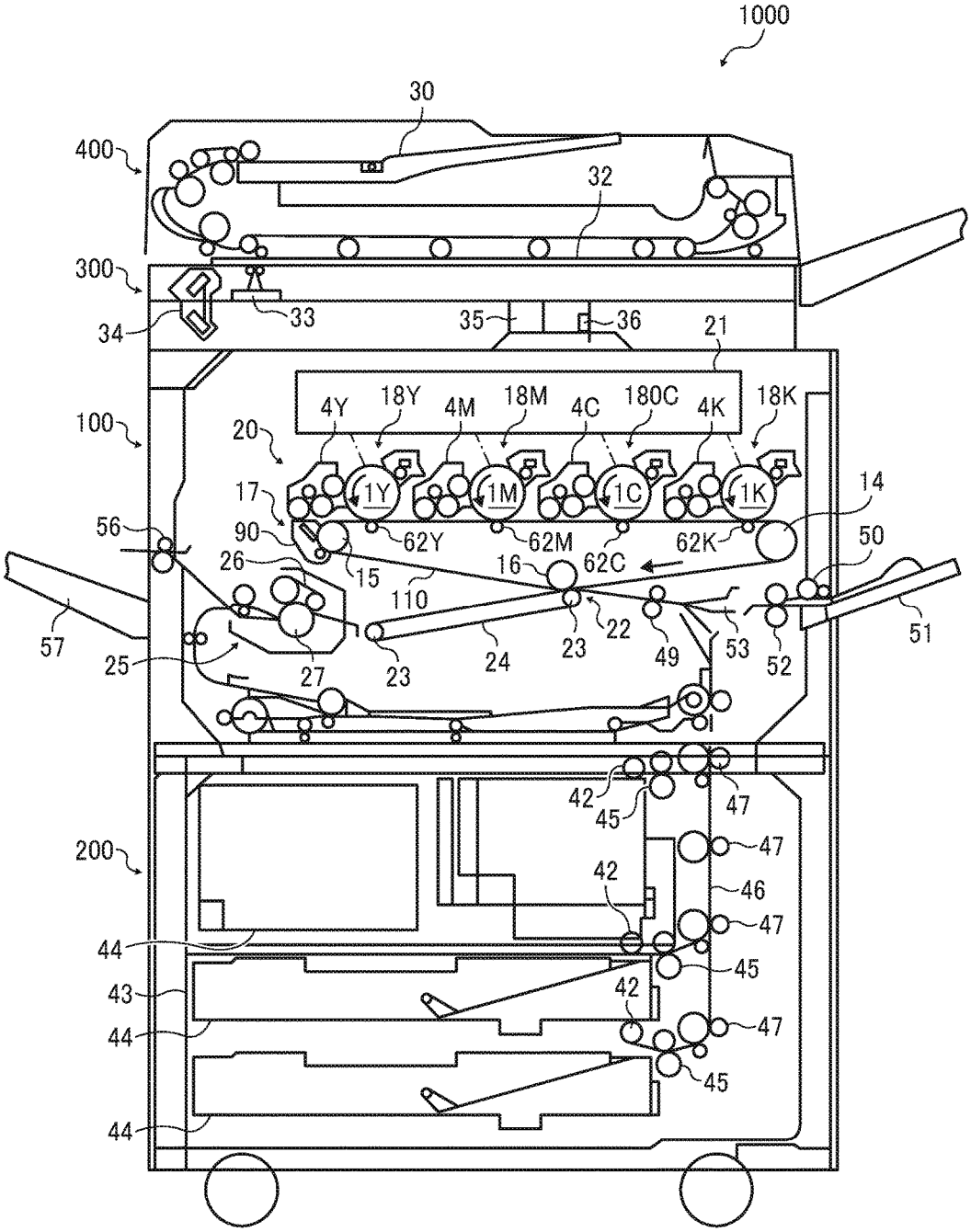
FIG. 1 schematic view of an image forming apparatus, such as a copier, according to an embodiment.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an embodiment, which is, for example, a tandem-type multicolor laser copier including multiple photoconductors arranged side by side, is described. As used herein, the singular forms "a", "an", and "the" are intended to include the plural forms as well, unless the context clearly indicates otherwise.

A basic structure of an image forming apparatus 1000 according to the present embodiment is described.

FIG. 1 is a schematic view of an interior of the image forming apparatus 1000.

The image forming apparatus 1000 includes a printer body 100, a sheet feeder 200 on which the printer body 100 is mounted, and a scanner 300 secured on the printer body 100. The image forming apparatus 1000 further includes an automatic document feeder (ADF) 400 mounted on the scanner 300.

The printer body 100 includes a tandem unit 20 including four image forming units 18Y, 18M, 18C, and 18K (also collectively "mage forming units 18") for forming yellow (Y), magenta (M), cyan (C), and black (K) images. Note that suffixes Y, M, C, and K attached to each reference numeral indicate that components indicated thereby are used for forming yellow, magenta, cyan, and black images, respectively.

The image forming apparatus 1000 further includes an optical writing unit 21, an intermediate transfer unit 17, a secondary transfer device 22, a registration roller pair 49, and a belt-type fixing device 25. The optical writing unit 21 includes a light source, a polygon mirror, an f-θ lens, and reflection mirrors, and is configured to emit laser beams onto the surfaces of photoconductors 1 according to image data.

Each of the image forming units 18Y, 18M, 18C, and 18K includes the photoconductor 1 (1Y, 1M, 1C, or 1K), which is drum-shaped, a charging device, a developing device 4 (4Y, 4M, 4C, or 4K), a drum cleaning device, and a discharger. The image forming unit 18Y for yellow is described in further detail below, as an example. The charging device uniformly charges the surface of the photoconductor 1Y. Then, the optical writing unit 21 irradiates the charged surface of the photoconductor 1Y, with a laser beam, which is modulated and deflected. The laser beam (exposure light) attenuates the electrical potential of the irradiated portion of the photoconductor 1Y. Thus, an electrostatic latent image for yellow is formed on the surface of the photoconductor 1Y. Then, the developing device 4Y develops the electrostatic latent image on the photoconductor 1Y into a yellow toner image.

The yellow toner image is primarily transferred from the photoconductor 1Y onto an intermediate transfer belt 110. Subsequently, the drum cleaning device removes toner remaining on the surface of the photoconductor 1Y. Thereafter, the discharger removes electric charge from the surface of each photoconductor 1Y to initialize the surface potential. A sequence of process described above is performed in the image forming units 18M, 18C, and 18K, similarly.

The intermediate transfer unit 17 includes the intermediate transfer belt 110, a belt cleaning device 90, a tension roller 14, a driving roller 15, a backup roller 16, and four primary-transfer bias rollers 62 (62Y, 62M, 62C, and 62K). The intermediate transfer belt 110 is looped taut, around a plurality of rollers including the tension roller 14. As the driving roller 15 is rotated by a belt driving motor, the intermediate transfer belt 110 rotates clockwise in the drawing.

The four primary-transfer bias rollers 62 are disposed in contact with an inner surface (on the inner side of the loop) of the intermediate transfer belt 110, and a power supply applies a primary transfer bias to the primary-transfer bias rollers 62. The four primary-transfer bias rollers 62 press the intermediate transfer belt 110 against the photoconductors 1 from inside the loop. That is, the intermediate transfer belt 110 is nipped between the primary-transfer bias rollers 62 and the photoconductors 1, and the contact portions therebetween are called primary transfer nips. The primary transfer bias causes a primary-transfer electrical field between the photoconductor 1 and the primary-transfer bias roller 62 in the primary transfer nip.

The yellow toner image is transferred from the photoconductor 1Y onto the intermediate transfer belt 110 with the effects of the primary-transfer electrical field and the nip pressure. Subsequently, magenta, cyan, and black toner images are transferred from the photoconductors 1M, 1C, and 1K, respectively, and superimposed one on another on the yellow toner image. Thus, a superimposed four-color toner image is formed on the intermediate transfer belt 110.

The four-color toner image on the intermediate transfer belt 110 is transferred onto a transfer sheet (i.e., a recording medium) in the secondary transfer nip (secondary transfer process). The belt cleaning device 90 is disposed downstream from the secondary-transfer nip in the sheet conveyance direction and opposed to the driving roller 15 via the intermediate transfer belt 110. The belt cleaning device 90 removes toner remaining on the intermediate transfer belt 110 after the secondary transfer process.

The secondary transfer device 22 is disposed below the intermediate transfer unit 17 in FIG. 1 and includes a conveyor belt 24 looped around two tension rollers 23. The conveyor belt 24 rotates counterclockwise in the drawing as at least one of the two tension rollers 23 rotates. The intermediate transfer belt 110 and the conveyor belt 24 are nipped between the backup roller 16 of the intermediate transfer unit 17 and the tension roller 23 on the right in FIG. 1. Thus, the intermediate transfer belt 110 of the intermediate transfer unit 17 is in contact with the conveyor belt 24, forming the secondary-transfer nip. A secondary transfer bias opposite in polarity to the toner is applied to the tension roller 23 on the right from a power supply.

The secondary-transfer bias generates a secondary-transfer electrical field in the secondary transfer nip to electrically transfer the four-color toner image from the intermediate transfer belt 110 toward the tension roller 23. Timed to coincide with the four-color toner image on the intermediate transfer belt 110, the registration roller pair 49 forwards the transfer sheet to the secondary transfer nip, and the four-color toner image is secondarily transferred on the transfer sheet.

The sheet feeder 200 disposed below the printer body 100 includes a sheet bank 43, in which a plurality of sheet feeding trays 44 are stacked one on another in a vertical direction. Each sheet feeding tray 44 can contain a bundle of transfer sheets. Each sheet feeding tray 44 is provided with a sheet feeding roller 42 pressed against the transfer sheet on the top in the sheet feeding tray 44. As the sheet feeding roller 42 rotates, the transfer sheet is conveyed to a feeding path 46.

A plurality of conveyance roller pairs 47 is disposed along the feeding path 46, and the registration roller pair 49 is disposed at an end of the feeding path 46. The transfer sheet is conveyed toward the registration roller pair 49 and then nipped in the registration roller pair 49. Meanwhile, in the intermediate transfer unit 17, the four-color toner image on the intermediate transfer belt 110 is transported to the secondary transfer nip as the intermediate transfer belt 110 rotates. The registration roller pair 49 forwards the transfer sheet nipped therebetween so that the transfer sheet tightly contacts the four-color image in the secondary transfer nip.

In the secondary transfer nip, the four-color superimposed toner image on the intermediate transfer belt 110 tightly contacts the transfer sheet. The four-color superimposed toner image becomes a full-color image on a while sheet. As the conveyor belt 24 rotates, the transfer sheet carrying the full-color toner image is discharged from the secondary transfer nip and conveyed to the fixing device 25.

The fixing device 25 includes a belt unit to rotate a fixing belt 26 looped around two rollers as well as a pressure roller 27 pressed against one of the two rollers of the belt unit. The fixing belt 26 and the pressure roller 27 press against each other, forming a fixing nip therebetween. The transfer sheet conveyed by the conveyor belt 24 is clamped in the fixing nip. A heat source is disposed inside the roller against which the pressure roller 27 presses to heat the fixing belt 26. The pressed fixing belt 26 heats the transfer sheet nipped in the fixing nip. With the heat and the nip pressure, the full-color toner image is fixed on the transfer sheet (fixing process).

After the fixing process, discharge rollers 56 discharge the transfer sheet to a stack tray 57 protruding, to the left in the drawing, from the printer body 100. Alternatively, the transfer sheet is conveyed again to the secondary transfer nip for duplex printing.

To make copies of a bundle of documents, a user places the bundle of documents, for example, on a document table 30 of the ADF 400. Note that, if the bundle of documents is bound like a book on one side (side-stitched documents), the bundle is placed on an exposure glass 32 of the scanner 300. Specifically, the user lifts the ADF 400 relative to the printer body 100 to expose the exposure glass 32 of the scanner 300, sets the bundle on the exposure glass 32, and then lowers the ADF 400 to hold the bundle with the ADF 400.

Then, the user presses a copy start switch, and the scanner 300 starts reading the image data of the document. When documents are set on the ADF 400, the ADF 400 automatically conveys the documents to the exposure glass 32 before reading of image data. In reading of image data, the first and second carriages 33 and 34 start moving, and the first carriage 33 directs an optical beam from the light source onto the document. Subsequently, the optical beam reflected from the surface of the document is reflected by the mirror of the second carriage 34, passes through the imaging forming lens 35, and then enters the reading sensor 36. Thus, the reading sensor 36 captures the image data of the document.

In parallel to reading of image data, components of the image forming units 18Y, 18M, 18C, and 18K, the intermediate transfer unit 17, the secondary transfer device 22, and the fixing device 25 start operating. According to the image data obtained by the reading sensor 36, the optical writing unit 21 is driven, and yellow, magenta, cyan, and black toner images are formed on the photoconductors 1Y, 1M, 1C, and 1K, respectively. These toner images are superimposed on the intermediate transfer belt 110 into a four-color toner image.

Almost simultaneously with the start of image data reading, the sheet feeder 200 starts feeding the transfer sheets. Specifically, one of the sheet feeding rollers 42 is selectively rotated, and the transfer sheets are fed from the corresponding sheet feeding tray 44 in the sheet bank 43. The transfer sheets are fed one by one to the feeding path 46, separated by a separation roller 45, after which the conveyance roller pairs 47 convey the transfer sheet to the secondary transfer nip. Instead of the sheet feeding tray 44, the transfer sheets may be fed from a side tray 51 (i.e., a bypass tray) projecting from the side of the printer body 100. In this case, a sheet feeding roller 50 is rotated to feed the transfer sheets from the side tray 51, and a separation roller 52 forwards the transfer sheets one by one to a feed path 53 inside the printer body 100.

In a case of multicolor image formation, the intermediate transfer belt 110 is disposed with the upper side thereof substantially horizontal so that the photoconductors 1Y, 1M, 1C, and 1K are in contact with the upper side of the intermediate transfer belt 110. By contrast, when monochrome images (black toner images) are formed, an attitude adjustment mechanism tiles down the left side of the intermediate transfer belt 110 in FIG. 1, thus disengaging the intermediate transfer belt 110 from the photoconductors 1Y, 1M, and 1C. Then, only the photoconductor 1K of the four photoconductors 1Y, 1M, 1C, and 1K is rotated counterclockwise in FIG. 1. At that time, not only the photoconductors 1Y, 1M, and 1C but also the developing devices 4Y, 4M, and 4C are stopped to prevent wear of the photoconductors 1Y, 1M, and 1C and waste of developer.

Figure 2:
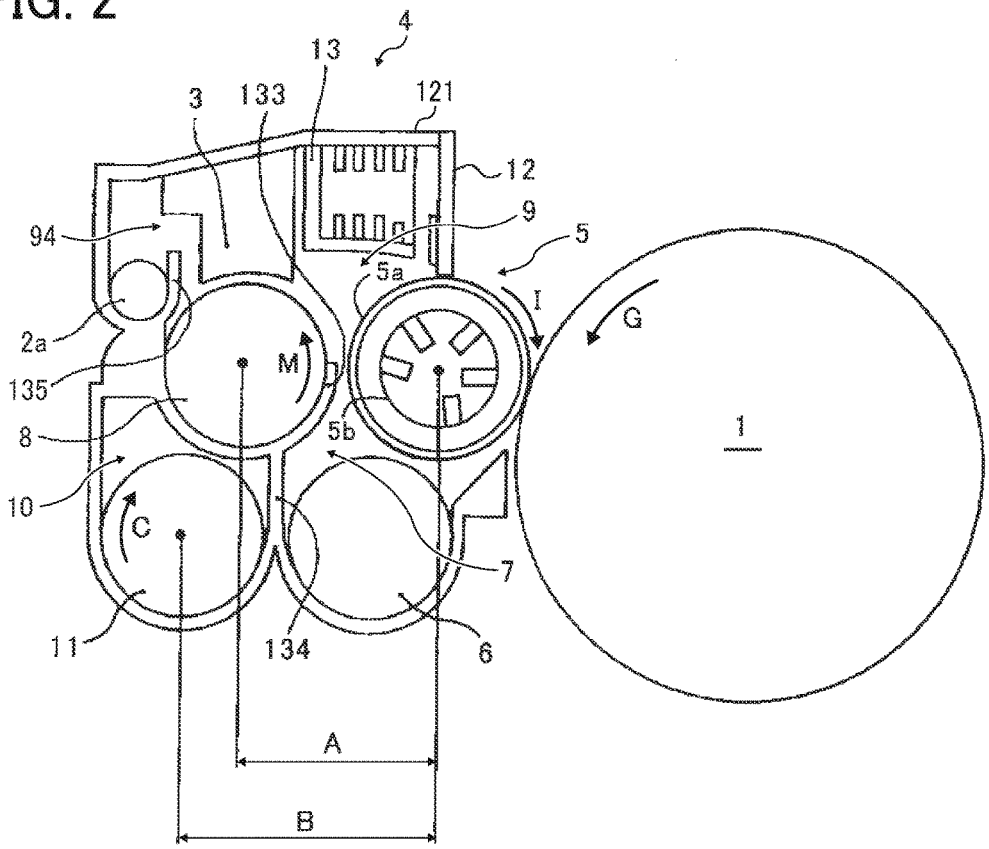
FIG. 2 is an enlarged end-on axial view of a developing device and a photoconductor of an image forming unit of the image forming apparatus illustrated in FIG. 1.

FIG. 2 is an enlarged end-on axial view of the developing device 4 and the photoconductor 1 of one of the image forming units 18Y, 18M, 18C, and 18K. Note that the four image forming units 18Y, 18M, 18C, and 18K have a similar configuration except the color of toner used therein, and the subscripts Y, K, M, and C attached to the end of reference numerals are omitted in FIG. 2.

While the photoconductor 1 rotates in the direction indicated by arrow G in FIG. 2, the charging device charges the surface of the photoconductor 1. Then, the optical writing unit 21 irradiates the charged surface of the photoconductor 1 with the laser beam to form an electrostatic latent image thereon. The developing device 4 supplies toner to the electrostatic latent image, thereby developing the latent image into a toner image.

The developing device 4 includes a developing roller 5, serving as a developer bearer, to supply toner to the electrostatic latent image on the photoconductor 1, thereby developing the latent image, while rotating in the direction indicated by arrow I in FIG. 2. A casing 121 of the developing device 4 serves as a developer containing compartment and contains developer including magnetic carrier and toner. The developing device 4 further includes a supply screw 8 disposed in a supply compartment 9 to transport the developer from the back side to the front side in the direction perpendicular to the surface of the paper on which FIG. 2 is drawn, while supplying the developer to the developing roller 5.

In the supply compartment 9, as the supply screw 8 rotates, the developer including magnetic carrier and toner is transported in the axial direction of the supply screw 8. The developing roller 5 includes a rotatable, hollow developing sleeve 5*a* and a magnet roller 5*b* disposed inside the developing sleeve 5*a* not to rotate together with the developing sleeve 5*a*. The developing sleeve 5*a* is made of a non-magnetic pipe. The magnet roller 5*b* has a plurality of magnetic poles arranged in the direction of rotation of the developing sleeve 5*a* (hereinafter "sleeve rotation direction") indicated by arrow I. While rotating and passing through a range opposing the supply compartment 9, the developing sleeve 5*a* attracts the developer, with the magnetic force exerted by a developer scooping pole of the magnet roller 5*b*. While passing through the range opposing the supply compartment 9, the developing sleeve 5*a* attracts the developer due to the magnetic force exerted by the magnet roller 5*b*. In a regulation gap (given reference G1 in FIG. 6), which is a gap between the surface of the developing sleeve 5*a* and an end of a regulation blade 12 serving as a developer regulator, the thickness of a layer of developer on the developing sleeve 5*a* is regulated.

After regulated in the regulation gap, the developer is transported to a developing range opposing the photoconductor 1, as the developing sleeve 5*a* rotates. Then, the developer is used for image developing. As the developing roller 5 rotates further, the developer is transported to a position opposing a collecting screw 6. At that position, two repulsive magnetic poles of the magnet roller 5*b* generates a repulsive magnetic field. The developer is separated from the developing sleeve 5*a* by the effect of the repulsive magnetic field and is collected by the collecting screw 6 in a collecting compartment 7.

A retained developer regulator 13 is disposed adjacent to the regulation blade 12 and upstream from the regulation blade 12 in the direction of rotation of the developing sleeve 5*a* indicated by arrow I. The retained developer regulator 13 adjusts the amount of developer staying adjacent to and upstream from the regulation blade 12. The retained developer regulator 13 is an opposing component disposed opposing the surface of the developing sleeve 5*a*, via a retention gap (given reference "G2" in FIG. 6) greater than the regulation gap (given reference "G1" in FIG. 6). That is, the distance from the developing sleeve 5*a* to the retained developer regulator 13 is greater than the regulation gap.

At a position lower than the supply compartment 9 and on a side of the collecting compartment 7, a stirring compartment 10 is disposed. In the stirring compartment 10, as a stirring screw 11 rotates, the developer is transported from the back side to the front side in a direction perpendicular to the surface of the paper on which FIG. 2 is drawn and opposite the direction in which the developer is transported in the supply compartment 9. The developing device 4 further includes a first partition 133 that separates, at least partly, the supply compartment 9 from the stirring compartment 10. Although separated by the first partition 133, the supply compartment 9 and the stirring compartment 10 communicate with each other through openings in both axial end portions, which are respectively on the front side and the back side of the paper on which FIG. 2 is drawn.

The first partition 133 further separates the supply compartment 9 from the collecting compartment 7, and no opening is provided to allow continuity between the supply compartment 9 and the collecting compartment 7. Additionally, a second partition 134 separates the stirring compartment 10 from the collecting compartment 7. Although separated by the second partition 134, an opening (second communication portion) through which the stirring compartment 10 communicates with the collecting compartment 7 is provided in an end portion on the front side in the direction perpendicular to the surface of the paper on which FIG. 2 is drawn.

In the present embodiment, the supply screw 8, the collecting screw 6, and the stirring screw 11, serving as developer conveyors, are made of resin or metal. The supply screw 8 is a double-threaded screw. The collecting screw 6 and the stirring screw 11 are single-threaded screws.

The developing sleeve 5*a* has a surface having V-shaped grooves or a sandblasted surface having a plurality of recesses. The developing sleeve 5*a* is made of an aluminum (Al) base pipe or a stainless steel pipe, e.g., a pipe of Steel Use Stainless (SUS). The regulation blade 12 is at a distance from the photoconductor 1 to secure the regulation gap.

The developer collected in the collecting compartment 7 is transported from the back side to the front side in the direction perpendicular to the surface of the paper on which FIG. 2 is drawn. Then, the developer enters the stirring compartment 10 through the opening at the end on the front side in that direction. Immediately after entering the stirring compartment 10, the developer is mixed with toner supplied from a toner supply inlet on the upper side of the stirring compartment 10. The developer is transported to the end of the collecting compartment 7, on the front side on the paper on which FIG. 2 is drawn, and enters the supply compartment 9, through the opening at the end of the first partition 133, on the front side of the paper on which FIG. 2 is drawn.

In the supply compartment 9, while the developer is transported from the front side to the back side of the paper on which FIG. 2 is drawn by the supply screw 8, a portion of the developer is scooped onto the developing roller 5. The rest of the developer is transported to the end of the supply compartment 9 on the back side of the paper on which FIG. 2 is drawn and returned to the stirring compartment 10, through the opening at the end on the back side of the first partition 133. On a bottom plate of the stirring compartment 10, a toner concentration sensor is disposed. According to an output from the toner concentration sensor, a controller drives the toner supply device to recover the concentration (or percentage of toner) in the developer.

Adjacent to the downstream end of the supply compartment 9 in the developer conveyance direction therein, a developer outlet 94 is disposed. When the level (height) of the developer in the supply compartment 9 exceeds a threshold, the developer flows out the developer outlet 94. A discharge screw 2*a* discharges the developer outside the developing device 4.

There are cases where, due to the momentum of the developer being conveyed or the force of the rotating supply screw 8, the developer in the supply compartment 9 is flipped up and discharged through the developer outlet 94 although the level of the developer is lower than the threshold. To prevent such unnecessary discharge, a block 3 is disposed in an upper portion of the supply compartment 9 so that the developer flipped by the rotation of the supply screw 8 contacts the block 3 and returns to the supply screw 8. The block 3 is made of resin and has a rounded bottom face in conformity with the shape of the supply screw 8. Owing to the round shape conforming to the shape of the supply screw 8, an entire bottom face of the block 3 is disposed close to the supply screw 8 to cover the supply screw 8. Thus, the developer is inhibited from being flipped up.

In the structure illustrated in FIG. 2, a distance A between an axis of the developing roller 5 and an axis of the supply screw 8 is shorter than a distance B between the axis of the developing roller 5 and an axis of the stirring screw 11.

Figure 3:
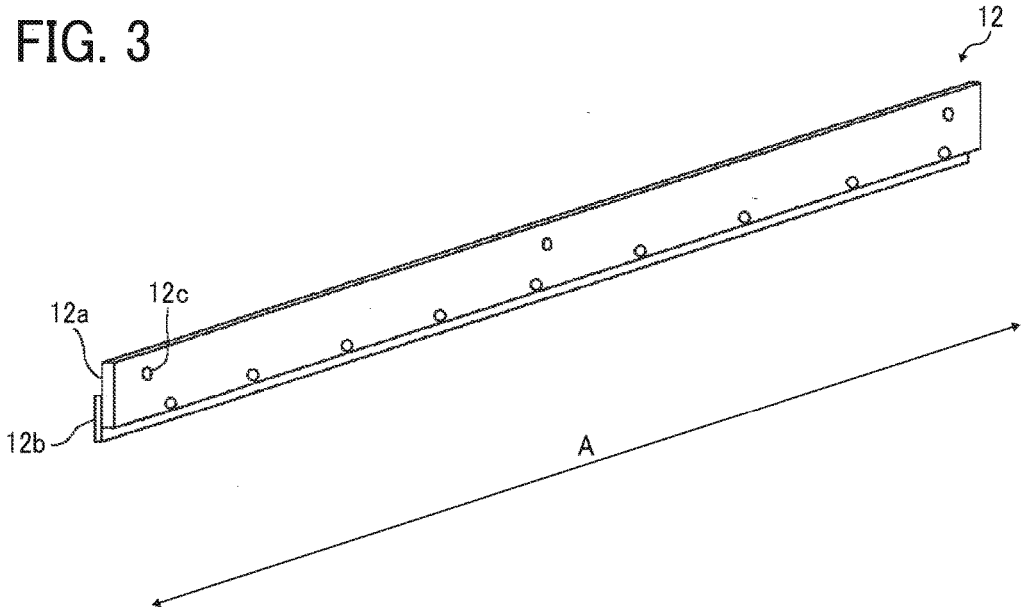
FIG. 3 is a perspective view of a regulation blade of the developing device illustrated in FIG. 3.

FIG. 3 is a perspective view of the regulation blade 12 of the developing device 4. The regulation blade 12 includes a blade body 12*a* shaped like a plate, and a magnetic end plate 12*b* shaped like a plate. The blade body 12*a* is made of stainless steel or the like. The blade body 12*a* is formed as a relatively thick plate so that the entire regulation blade 12 has a certain degree of rigidity. The magnetic end plate 12*b* is an end portion of the regulation blade 12 disposed opposing the developing sleeve 5*a*. The magnetic end plate 12*b* is formed as a relatively thin plate. The magnetic end plate 12*b* is secured to en end portion of an upstream side of the blade body 12*a* in the sleeve rotation direction. In the present embodiment, the magnetic end plate 12*b* is attached to the blade body 12*a* with a plurality of screws. The regulation gap (G1 in FIG. 6) is set at 0.4 mm to 0.6 mm. The retention gap (G2 in FIG. 6) is set at 0.9 mm to 1.1 mm.

Figure 4:
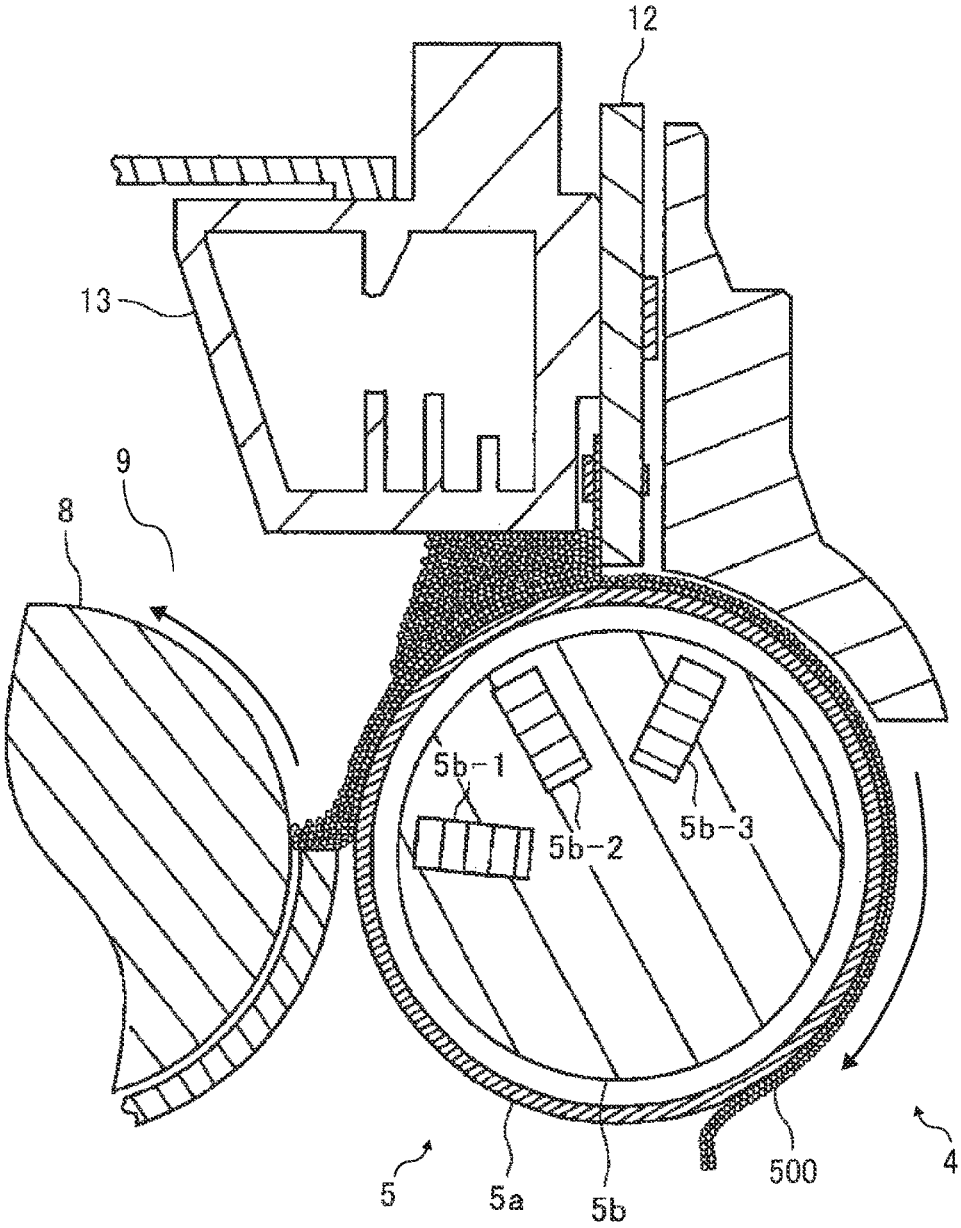
FIG. 4 is an enlarged cross-sectional view of an area around a developing roller of a developing device according to a comparative example.

Creation of an immobile layer of developer is described with reference to FIG. 4. FIG. 4 is an enlarged, partial cross-sectional view around the developing sleeve 5*a*. The magnet roller 5*b* inside the developing sleeve 5*a* has five or more magnetic poles arranged in the sleeve rotation direction indicated by arrow I, but only a developer scooping pole 5*b*-1, a regulation pole 5*b*-2, and a post-regulation pole 5*b*-3 (disposed downstream from the regulation pole 5*b*-2 in the sleeve rotation direction) are illustrated in FIG. 4.

The developing sleeve 5*a* is a nonmagnetic pipe and rotates clockwise in FIG. 4. At the position opposing the supply screw 8, the developing sleeve 5*a* attracts developer 500 inside the supply compartment 9, with the magnetic force exerted by the developer scooping pole 5*b*-1. Then, the developer 500 is borne on the surface of the developing sleeve 5*a*. As the developing sleeve 5*a* rotates, the developer 500 thereon enters the range opposing the regulation pole 5*b*-2. The regulation pole 5*b*-2 is to attract the developer to the surface of the developing sleeve at a position where the regulation blade 12 regulates the layer thickness of the developer on the developing sleeve 5*a*. Due to the magnetic force exerted by the regulation pole 5*b*-2, the developer 500 stands on end, forming a magnetic brush, on the surface of the developing sleeve 5*a*. Subsequently, as the developing sleeve 5*a* rotates, the developer 500 enters the range opposing the regulation blade 12, where movement of an end side of the magnetic brush is inhibited. Thus, the layer of developer 500 is regulated to have a predetermined thickness. The developer 500 inhibited by the regulation blade 12 from rotating together with the developing sleeve 5*a* stays (is retained) in an area upstream from the regulation blade 12 in the sleeve rotation direction. The retained developer regulator 13 sets, to a constant amount, the volume of the space between the retained developer regulator 13 and the developing sleeve 5*a*, thereby regulating the amount of developer 500 retained.

When the degree of degradation of magnetic carrier particles is not high, the developer 500 has a certain preferable degree of flowability. Accordingly, while being rubbed by the developer 500 rotating together with the developing sleeve 5*a*, the magnetic carrier particles in the retained developer 500, which stays upstream from the regulation blade 12 in the sleeve rotation direction, actively rotate. The magnetic carrier particles are gradually mixed in the developer 500 rotating together with the developing sleeve 5*a*. Eventually, the magnetic carrier particles pass through the regulation gap and contribute to image developing.

Figure 5:
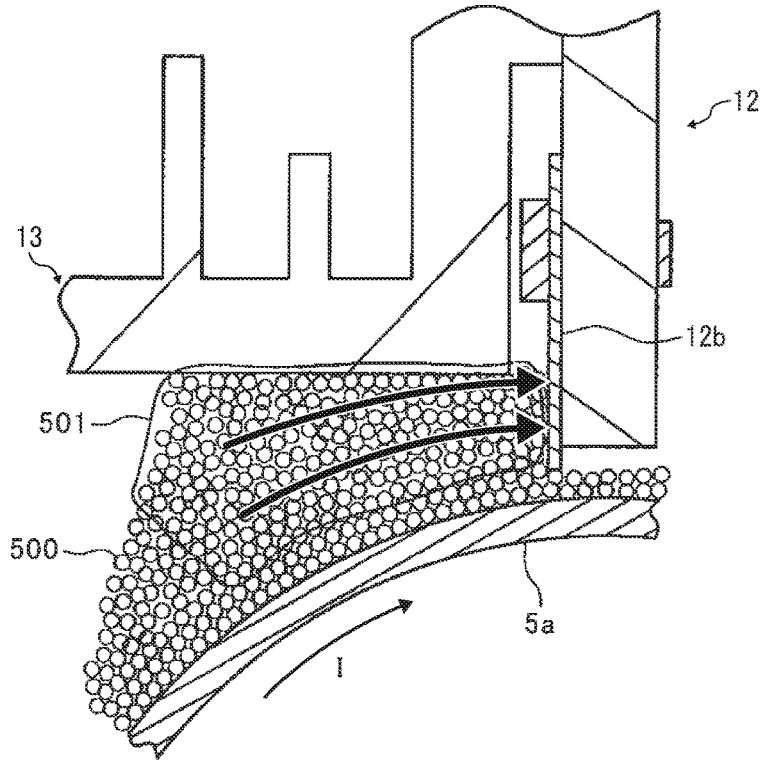
FIG. 5 is a partial cross-sectional view of the developing device illustrated in FIG. 4, together with developer retained upstream from the regulation blade in a sleeve rotation direction.

The flowability of the developer 500, however, deteriorates as the degradation of the magnetic carrier particles progresses due to adhesion (or coagulation) of a toner component. Then, the movement of the developer 500 retained upstream from the regulation blade 12 in the sleeve rotation direction is slowed. Then, as illustrated in FIG. 5, differently from the above-described state in which magnetic carrier particles individually rotate, the retained developer 500 as a whole is about to move in the sleeve rotation direction. However, a side face of the magnetic end plate 12*b* of the regulation blade 12 inhibits the developer 500 from moving as a whole. This action creates an immobile layer 501 of developer 500 on the side upstream from the regulation blade 12 in the sleeve rotation direction. In the immobile layer 501, individual movements of the magnetic carrier particles are rarely recognized.

When the immobile layer 501 is created, friction is caused between the immobile layer 501 and the developer 500 rotating together with the developing sleeve 5*a*, and heat due to the friction is kept in the immobile layer 501. The heat melts the toner and aggravates the degradation of the developer 500 in the immobile layer 501. As the degradation is aggravated, the thickness of the immobile layer 501 increases gradually. Eventually, the immobile layer 501 protrudes beyond the end of the regulation blade 12 toward the developing sleeve 5*a*. In this state, the immobile layer 501 regulates, with a gap narrower than the regulation gap, the thickness of the developer rotating together with the developing sleeve 5*a*. Accordingly, the thickness of the developer becomes insufficient, making the density of a developed image insufficient.

In view of the foregoing, an aspect of the present embodiment is described below.

Figure 6:
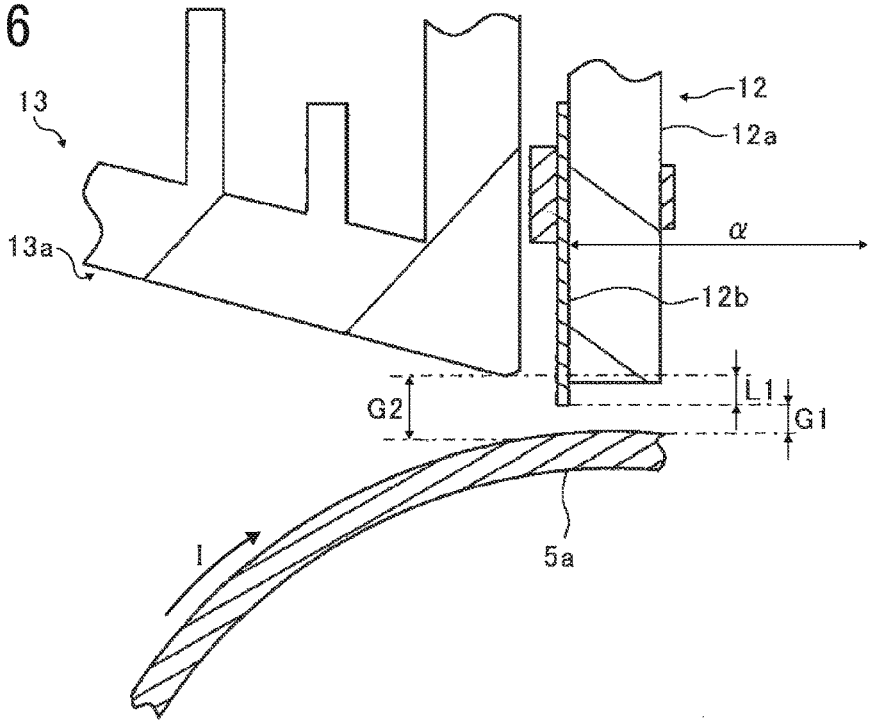
FIG. 6 is an enlarged view of a regulation gap and a portion adjacent thereto, in a developing device according to an embodiment.

FIG. 6 is an enlarged view of the regulation gap in the developing device 4 and the adjacent portion according to the present embodiment. In FIG. 6, the retained developer regulator 13 includes an inclined opposing face 13*a* opposing the developing sleeve 5*a*. Arrow a indicates an orthogonal plane direction, which is orthogonal to a left side face in FIG. 6 of the magnetic end plate 12*b* of the regulation blade 12. The inclined opposing face 13*a* is inclined relative to the orthogonal plane direction $\alpha$ such that the inclined opposing face 13*a* progressively approaches the developing sleeve 5*a* as a position on the developing sleeve 5*a* shifts from the upstream side to the downstream side in the sleeve rotation direction indicated by arrow I.

The retention gap G2 (the distance) between the inclined opposing face 13*a* of the retained developer regulator 13 and the developing sleeve 5*a* is greater than the regulation gap G1.

Figure 7:
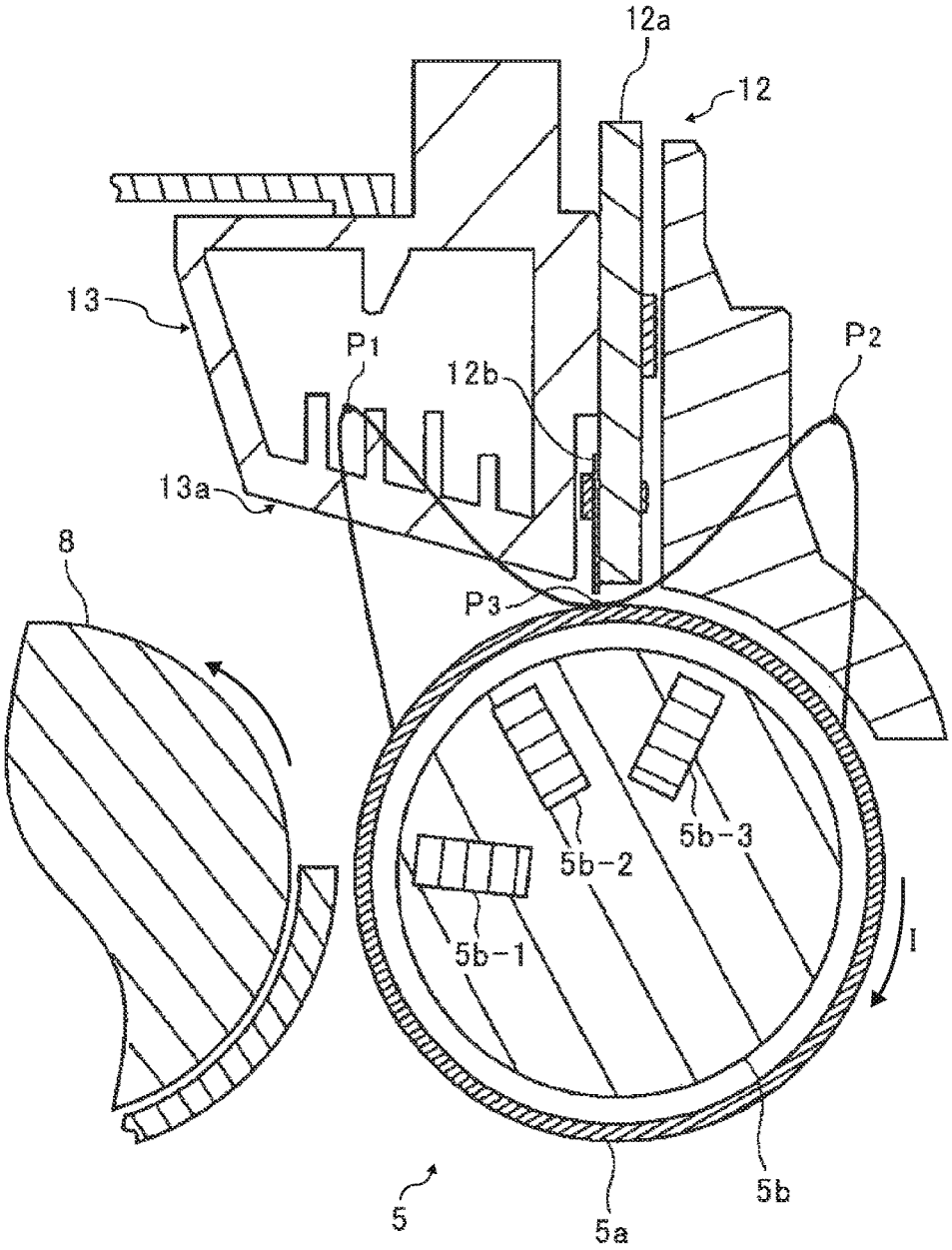
FIG. 7 is an end-on axial view of the developing device illustrated in FIG. 6, together with distribution of magnetic force of a regulation pole and distribution of magnetic force of a downstream regulation pole.

FIG. 7 is an end-on cross-sectional view of the developing device 4, together with distribution of magnetic force of the regulation pole 5*b*-2 and distribution of magnetic force of the post-regulation pole 5*b*-3. In FIG. 7, a bold curved line around the developing sleeve 5*a* represents the magnetic force exerted by the magnetic poles in the direction normal to the sleeve surface. In the developing device 4, a maximum point P1 of the magnetic force of the regulation pole 5*b*-2 is disposed upstream from the regulation blade 12 in the sleeve rotation direction, and a maximum point P2 of the magnetic force of the post-regulation pole 5*b*-3 is disposed downstream from the regulation blade 12 in the sleeve rotation direction. A minimum point P3, which is a point of intersection between the two distributions of magnetic force, faces an end of the magnetic end plate 12*b* of the regulation blade 12. The magnetic force of each of the regulation pole 5*b*-2 and the post-regulation pole 5*b*-3 in the direction normal to the surface of the developing sleeve 5*a* is minimum at the minimum point P3. At the minimum point P3, the magnetic lines of force extend in the direction tangential to the sleeve surface. The tangential direction matches the direction in which the developer passes through the regulation gap G1.

The maximum point P1 of the magnetic force of the regulation pole 5*b*-2 may be disposed on an extension of the magnetic end plate 12*b* so that the developer stands on end highest at the position opposing the magnetic end plate 12*b*. In such an arrangement, however, inside the regulation gap G1 (illustrated in FIG. 6), the sleeve surface attracts the developer that is about to move in the direction tangential to the sleeve surface. As the degradation of developer progresses, the flowability of the developer is degraded. The developer having a degraded flowability passes through the regulation gap G1 less easily. Then, the layer thickness of the developer borne on the sleeve surface becomes insufficient, making the image density insufficient.

In view of the foregoing, in the present embodiment, as illustrated in FIG. 7, the minimum point P3 is disposed opposing the end of the magnetic end plate 12*b*. With this arrangement, in the regulation gap G1, the magnetic lines of force are oriented in the direction of movement of developer, thereby inhibiting retention of developer in the regulation gap G1 to keep the layer thickness of the developer sufficient.

In the arrangement in which the minimum point P3 faces the end of the magnetic end plate 12*b*, however, most of the distribution of magnetic force of the regulation pole 5*b*-2 in the normal direction falls in a retaining space upstream from the regulation blade 12, where the developer stays. Accordingly, an immobile layer of developer is easily created. Therefore, in the present embodiment, as described above, the face (i.e., the inclined opposing face 13*a*) of the retained developer regulator 13 opposing the developing sleeve 5*a* is inclined relative to the orthogonal plane direction α.

Figure 8:
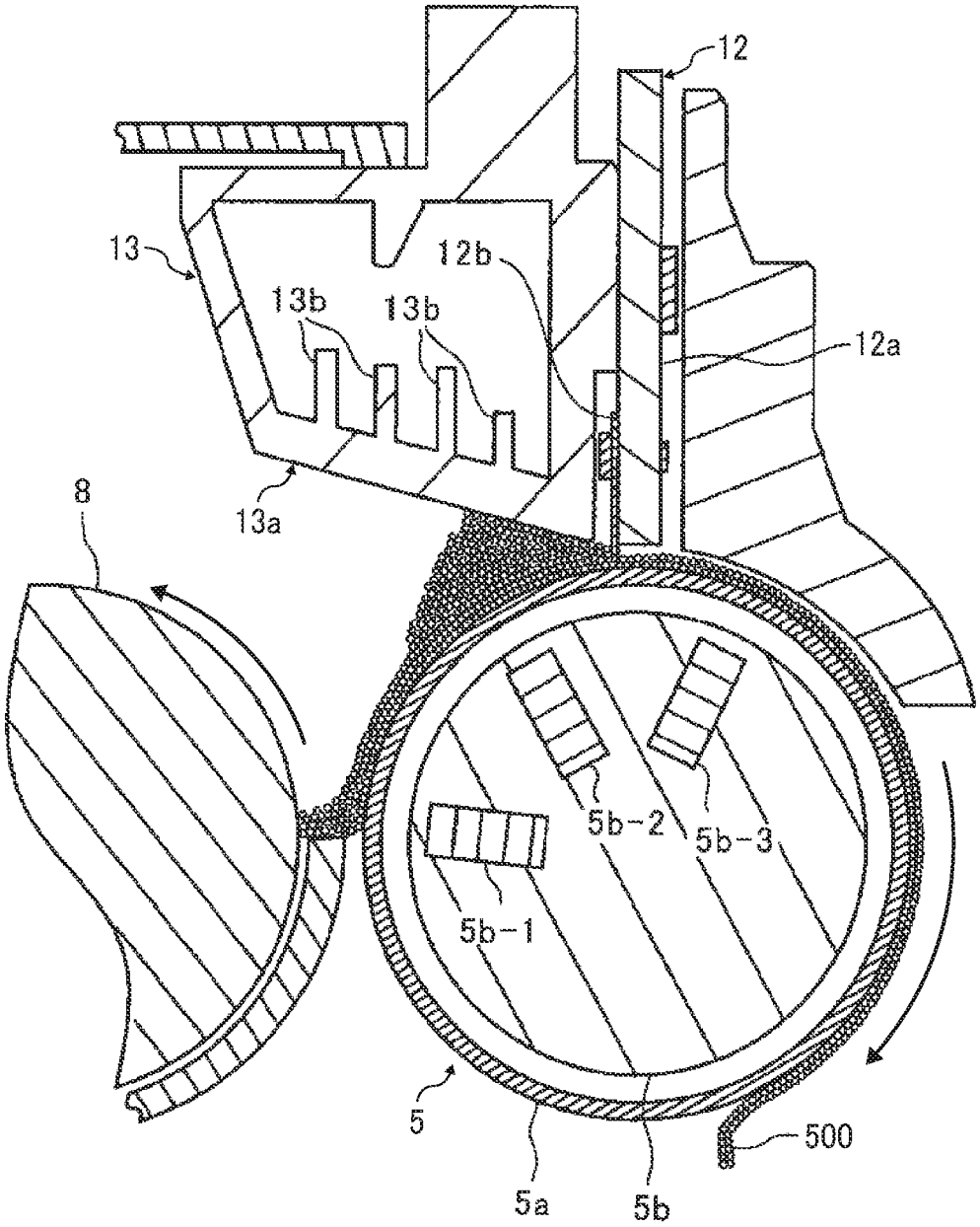
FIG. 8 is an enlarged cross-sectional view of an area around the developing roller of the developing device illustrated in FIG. 7.

FIG. 8 is an enlarged cross-sectional view of the developing roller 5 and an adjacent portion of the developing device 4 according to the present embodiment. In the present embodiment, as illustrated in FIG. 8, the developer 500 staying on the upstream side of the regulation blade 12 in the sleeve rotation direction, indicated by arrow I, is pressed to the inclined opposing face 13*a* as the developing sleeve 5*a* rotates.

Figure 9:
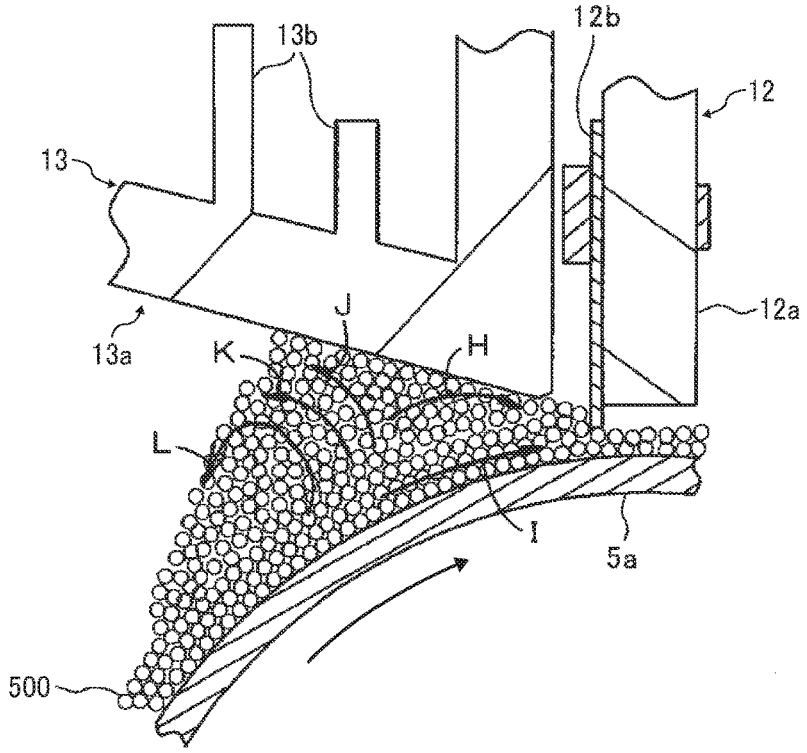
FIG. 9 is an enlarged, partial cross-sectional view of the developing device illustrated in FIG. 8, together with staying developer.

FIG. 9 is an enlarged, partial cross-sectional view of the developing device 4, together with the staying developer. In FIG. 9, as the developing sleeve 5*a* rotates, the developer 500 presses to the inclined opposing face 13*a* of the retained developer regulator 13 moves in the direction indicated by arrow H, along the inclined opposing face 13*a*. Ahead the developer 500 thus moving, the regulation gap G1, not the side face of the magnetic end plate 12*b*, is located. In other words, the developer 500 pressed to the inclined opposing face 13*a* is guided toward the regulation gap G1. This structure helps entry into the regulation gap G1. Thus, in a portion close to the regulation gap G1, the developer guided by the inclined opposing face 13*a* toward the regulation gap G1 flows as indicated by arrow H, above the developer 500 moving together with the developing sleeve 5*a* in the direction indicated by arrow I. Accordingly, creation of immobile layer of developer is inhibited. In a portion away from the regulation gap G1, subsequent developer slidingly contacts the developer 500 that is about to move, following the developer 500 moving in the direction indicated by arrow H along the inclined opposing face 13*a*. With the sliding contact, developer coming from further behind moves in counterclockwise vortex motion as indicated by arrows J, K, and L. With the vortex motion, at a position at a distance from the regulation gap G1, the developer actively moves, inhibiting creating of an immobile layer.

Thus, in a portion relatively close to the regulation gap G1 upstream from the regulation blade 12 in the sleeve rotation direction, the developer moves smoothly toward the regulation gap G1. Additionally, at a position at a distance from the regulation gap G1, the developer makes vortex motion. Accordingly, creation of an immobile layer is inhibited.

Note that, in FIG. 6, when a difference L1 between the regulation gap G1 and the retention gap G2 is extremely large, inhibiting the creating of immobile layer may become difficult even if the inclined opposing face 13*a* is inclined relative to the orthogonal plane direction α as illustrated in FIG. 6.

For an experiment, the inventors prepared a test printer having a configuration similar to that of the image forming apparatus 1000 according to the present embodiment and four retained developer regulator 13 different in thickness to make the size of the retention gap G2 different. For each of the four retained developer regulators 13, a reduction rate in scooping of developer was examined in the experiment.

Specifically, black solid images were printed on a certain number of sheets in a state in which fresh black toner was set in the developing device 4K, after which the developing device 4K was removed from the test printer. Then, while rotating the developing sleeve 5*a* of the developing device 4 for one complete rotation, the developer on the surface of the developing sleeve 5*a* was scraped by a scraper abutting against an exposed portion of the developing sleeve 5*a* exposed from the casing. Then, the weight of the developer scraped was measured as the amount of fresh developer scooped.

Then, the developer inside the developing device 4K was replaced with degraded developer in which the flowability was degraded. In that state, similarly, while rotating the developing sleeve 5*a* for one complete rotation, the developer on the surface of the developing sleeve 5*a* was scraped by the scraper abutting against the exposed portion of the developing sleeve 5*a* exposed from the casing. Then, the weight of the developer scraped was measured as the amount of degraded developer scooped. Then, from the amount of fresh developer scooped, the amount of degraded developer scooped was deducted to obtain a reduction. The percentage of the reduction relative to the amount of fresh developer scooped was obtained as the reduction rate in scooping (in percentage).

Since, the immobile layer is not created in the fresh developer having a preferable flowability, a layer of developer having a preferable thickness is borne on the surface of the developing sleeve 5*a* downstream from the regulation position by the regulation blade 12 in the sleeve rotation direction. By contrast, in the degraded developer having the degraded flowability, it is possible that the immobile layer is created when the difference L1 is relatively large. Since the immobile layer regulates the thickness of the developer on the developing sleeve 5*a* with a gap narrower than the regulation gap G1, the thickness of the developer is reduced. The rate of this reduction is represented by the above-described reduction rate in scooping.

Figure 10:
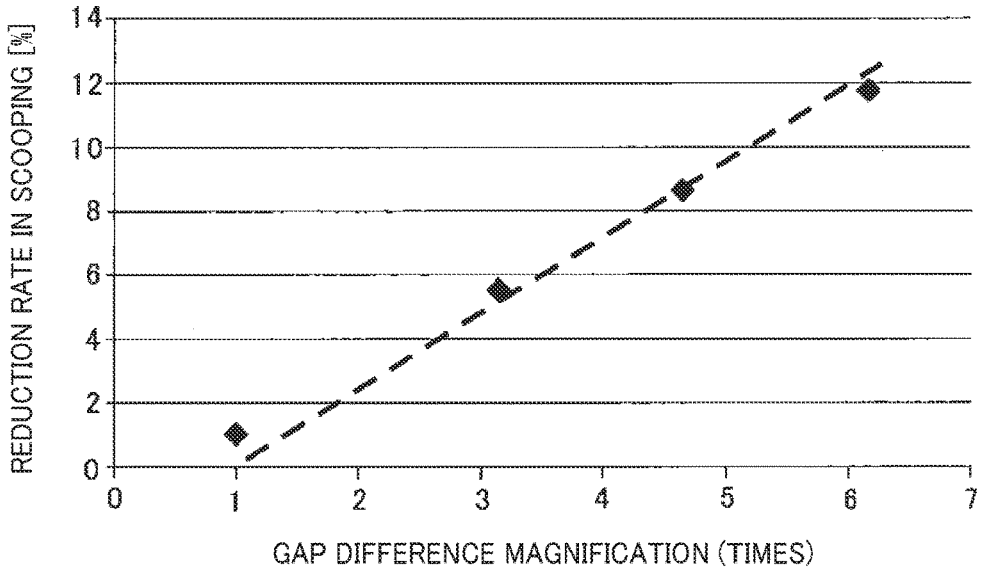
FIG. 10 is a graph illustrating a relation between a reduction rate and a gap different magnification.

FIG. 10 is a graph illustrating a relation between the reduction rate in scooping (percentage) and a gap difference magnification (in times or multiples). The term "gap difference magnification" represents how many times the regulation gap G1 as large as the difference L1. As the thickness of the developer decreases, that is, the amount of scooped developer decreases, the developing capability of the developing device 4 decreases, which is not desirable. An allowable upper limit of the reduction rate in scooping is about 2%. As illustrated in FIG. 10, when the gap difference magnification is not greater than 1.75, the reduction rate in scooping can be kept at or lower than 2%. In other words, it was experimentally ascertained that keeping the difference L1 at a value not greater than 1.75 times as large as the regulation gap G1 is effective in suppressing the creation of the immobile layer.

Therefore, in the image forming apparatus 1000 according to the present embodiment, the difference L1 is set to a value not greater than 1.75 times as large as the regulation gap G1.

The magnetic end plate 12*b* of the regulation blade 12 is made of a magnetic material, whereas the blade body 12*a* is made of a nonmagnetic material. The magnetic end plate 12*b* is significantly thinner than the blade body 12*a*. In such a configuration, the magnetic end plate 12*b* serves as a regulating portion of the regulation blade 12 to regulate the developer. When the magnetic force is dispersed, the thickness of the developer layer becomes unstable. Such an inconvenience is avoided by concentrating the magnetic force at the magnetic end plate 12*b* at the end of the regulation blade 12. Further, providing the blade body 12*a* to the magnetic end plate 12*b* can secure the rigidity of the entire regulation blade 12.

As illustrated in the drawings, the magnetic end plate 12*b* is secured to the upstream face of the blade body 12*a*, not the downstream face thereof, in the sleeve rotation direction. If the magnetic end plate 12*b* is secured to the downstream face, the developer regulated by an end portion of the magnetic end plate 12*b* projecting beyond the blade body 12*a* is retained in an area sandwiched between the end face of the blade body 12*a* and the developing sleeve 5*a* and extending for the thickness of the blade body 12*a*. Thus, the creation of the immobile layer is undesirably promoted. When the magnetic end plate 12*b* is secured to the upstream face, creation of the immobile layer is inhibited.

In the present embodiment, the magnetic end plate 12*b* is produced by perforation. At the end of the magnetic end plate 12*b* thus produced, an upstream-side edge in the direction of perforation has a face of shear droop, having a micro chamfer. By contrast, an edge on the downstream side of the magnetic end plate 12*b* in the direction of perforation has burrs (i.e., micro projections). If the burrs support, from below, the developer regulated by the magnetic end plate 12*b*, retention of the developer is promoted.

Therefore, in the present embodiment, the magnetic end plate 12*b* secured to the blade body 12*a* is in an attitude in which the edge having shear droop is disposed on the upstream side in the sleeve rotation direction. In this structure, the burrs at the end do not support, from below, the developer regulated by the regulation blade 12. Accordingly, retention of developer caused by the burrs can be avoided.

As illustrated in FIG. 8, the retained developer regulator 13 made of aluminum has a hollow structure, and an inner wall of the retained developer regulator 13 includes a plurality of ribs 13*b*, projecting inward, for heat radiation. The developing device 4 is provided with a fan that blows air into the hollow of the retained developer regulator 13. With this structure, the retained developer regulator 13 functions as a heatsink.

As described above, in the present embodiment, the developer regulated by the regulation blade 12 actively moves in the two vortex motions. The retained developer regulator 13 absorbs the heat generated, at that time, by the friction between the magnetic carrier particles. This configuration can suppress heat generation in the retained developer, and creation of the immobile layer is inhibited reliably.

The structures described above are just examples, and the various aspects of the present specification attain respective effects as follows.

Aspect A

Aspect A concerns a developing device that includes a developer bearer (e.g., the developing roller 5) to bear developer on a surface thereof and supply the developer to a latent image on a latent image bearer (e.g., the photoconductor 1) of an image forming apparatus; a developer regulator (e.g., the regulation blade 12) disposed opposite the developer bearer across a first gap (e.g., the regulation gap G1) to regulate a layer thickness of the developer borne on the developer bearer; and an opposing member (e.g., the retained developer regulator 13) having an opposing face opposing the developer bearer across a second gap (e.g., the retention gap G2). The opposing face is disposed adjacent to and upstream from the developer regulator in the direction of rotation of the developer bearer. The opposing face (e.g., the inclined opposing face 13*a*) is inclined relative to an orthogonal plane direction, which is orthogonal to a side face of the developer regulator. The opposing face is inclined to progressively reduce a distance from the developer bearer as a position on the opposing face shifts from the upstream side to the downstream side in the direction of rotation of the developer bearer. The first gap is narrower than the second gap, and a difference (e.g., the difference L1) between the second gap (e.g., the retention gap G2 between the inclined opposing face and the developer bearer) and the first gap is not greater than 1.75 times as large as the first gap.

In Aspect A, as the developer bearer rotates, in the developer pressed to the inclined opposing face of the opposing member, the developer close to the regulation gap moves along the inclined opposing face, following the rotation of the developer bearer. Ahead the developer thus moving, an edge on the end of the developer regulator and the regulation gap are located. In other words, the developer pressed to the inclined opposing face at a position relatively close to the regulation gap is guided toward the edge at the end of the developer regulator and the regulation gap. Then, the developer enters the regulation gap. Thus, at the position relatively close to the regulation gap, the developer flows toward the regulation gap, guided by the inclined opposing face. Accordingly, creation of an immobile layer of developer is inhibited. At the position away from the regulation gap, subsequent developer moves in vortex motion and slidingly contacts the developer that is about to move, following the developer moving toward the regulation gap. With the vortex motion, at a position relatively far from the regulation gap, creating of an immobile layer is inhibited.

Aspect B

In Aspect A, the developer includes toner and magnetic carrier, the developer bearer includes a hollow developing sleeve (e.g., the developing sleeve 5*a*) to rotate and a magnetic force generator (e.g., the magnet roller 5*b*) contained inside the developing sleeve not to rotate together with the developing sleeve. The developing sleeve bears the developer on the surface thereof. The magnetic force generator has a plurality of magnetic poles arranged in the sleeve rotation direction.

The plurality of magnetic poles includes a regulation pole (e.g., the regulation pole 5*b*-2) and a post-regulation pole (e.g., the post-regulation pole 5*b*-3). The regulation pole is to attract the developer to the surface of the developing sleeve at a position where the developer regulator regulates the layer thickness of the developer. The post-regulation pole is disposed adjacent to and downstream from the regulation pole in the sleeve rotation direction. A maximum point (e.g., the maximum point P1) of the magnetic force of the regulation pole 5*b*-2 in a direction normal to the surface of the developing sleeve is disposed upstream from the developer regulator in the sleeve rotation direction. A maximum point (e.g., the maximum P2) of the magnetic force of the post-regulation pole in the direction normal to the surface of the developing sleeve is disposed downstream from the developer regulator in the sleeve rotation direction.

This structure can better suppress the retention of the developer inside the regulation gap, compared with a structure in which the maximum point of the magnetic force exerted by the regulation pole is disposed opposing an end of the developer regulator.

Aspect C

In Aspect B, a minimum point (e.g., the minimum point P3), at which the magnetic force of each of the regulation pole and the post-regulation pole in the direction normal to the surface of the developing sleeve is minimum, is disposed opposing the end of the developer regulator. With this arrangement, the magnetic lines of force in the regulation gap are oriented in the direction of movement of developer in the regulation gap, and the developer can move smoothly through the regulation gap. Thus, the developer is not retained in the regulation gap.

Aspect D

In any one of Aspects A through C, the developer regulator includes a nonmagnetic plate (e.g., the blade body 12*a*), and a magnetic thin plate (e.g., the magnetic end plate 12*b*) thinner than the nonmagnetic plate. The thin plate is attached to the nonmagnetic plate and projecting beyond an end of the nonmagnetic plate toward the developer bearer. The thin plate is attached to an upstream-side face of the nonmagnetic plate facing the upstream side in the sleeve rotation direction.

If the magnetic force is dispersed at the end of the developer regulator, the thickness of the developer layer on the developing sleeve becomes unstable. By contrast, according to Aspect D, the magnetic force is concentrated at an end of the thin plate forming an end portion of the developer regulator, thereby avoiding the above-mentioned inconvenience. Additionally, this structure inhibits retention of developer in an area sandwiched between the end face of the nonmagnetic plate and the developing sleeve, extending for the thickness of the nonmagnetic plate.

Aspect E

In Aspect D, the thin plate is in an attitude in which an upstream-side edge at the end of the thin plate in the sleeve rotation direction is an edge of shear droop by perforation. In this structure, the burrs at another edge at the end of the thin plate do not support, from below, the developer regulated by the developer regulator. Accordingly, retention of developer caused thereby can be avoided.

Aspect F

In any one of Aspects A through E, the opposing member includes a plurality of ribs (e.g., the ribs 13*b*) for heat radiation, and the plurality of ribs is disposed on a face of the opposing member different from the inclined opposing face. In such a structure, the opposing member absorbs the heat generated by the friction between the developer particles regulated by the developer regulator. This structure inhibits creation of the immobile layer caused by the heat generation of developer.

Aspect G

In Aspect G, the opposing member is made of aluminum. In such a structure, since aluminum has a good thermal conduction rate, the opposing member made of aluminum can absorb heat from the developer preferably.

Aspect H

An image forming apparatus includes a latent image bearer (e.g., the photoconductor 1) to bear a latent image, and the developing device according to any one of Aspects A through G, to develop the latent image.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A developing device comprising:

a developer bearer to bear developer and supply the developer to a latent image on a latent image bearer;

a developer regulator disposed opposite the developer bearer, across a first gap, to regulate a layer thickness of the developer borne on the developer bearer;

an opposing member having an opposing face disposed opposing the developer bearer across a second gap, the opposing face disposed adjacent to and upstream from the developer regulator in a direction of rotation of the developer bearer, the opposing face inclined relative to an orthogonal plane direction orthogonal to a side face of the developer regulator, the opposing face being inclined to progressively reduce a distance from the developer bearer to the opposing face in a direction of rotation of the developer bearer;

the developer regulator includes a nonmagnetic plate; and a thin plate thinner than the nonmagnetic plate, the thin plate attached to the nonmagnetic plate and projecting beyond the nonmagnetic plate toward the developer bearer, the thin plate attached to an upstream-side face of the nonmagnetic plate facing an upstream side in the direction of rotation of the developer bearer, wherein the first gap is narrower than the second gap, and wherein a difference between the second gap and the first gap is not greater than 1.75 times as large as the first gap.

2. The developing device according to claim 1, wherein the developer includes toner and magnetic carrier, wherein the developer bearer includes:

a hollow developing sleeve to rotate and bear the developer; and a magnetic force generator contained inside the hollow developing sleeve not to rotate together with the hollow developing sleeve, the magnetic force generator having a plurality of magnetic poles arranged in the direction of rotation of the developer bearer, wherein the plurality of magnetic poles includes:

a regulation pole to attract the developer to a surface of the hollow developing sleeve at a position where the developer regulator regulates the layer thickness of the developer; and a post-regulation pole disposed adjacent to and downstream from the regulation pole in the direction of rotation of the developer bearer, wherein a maximum point of a magnetic force of the regulation pole in a direction normal to the surface of the hollow developing sleeve is disposed upstream from the developer regulator in the direction of rotation of the developer bearer, and wherein a maximum point of a magnetic force of the post-regulation pole in the direction normal to the surface of the hollow developing sleeve is disposed downstream from the developer regulator in the direction of rotation of the developer bearer.

3. The developing device according to claim 2, wherein a minimum point, at which the magnetic force of each of the regulation pole and the post-regulation pole in the direction normal to the surface of the hollow developing sleeve is minimum, is disposed opposing an end of the developer regulator.

4. The developing device according to claim 1, wherein the side face of the developer regulator opposes the upstream side in the direction of rotation of the developer bearer.

5. The developing device according to claim 1, wherein an upstream-side edge at an end of the thin plate has a chamfered edge, the upstream-side edge facing the upstream side in the direction of rotation of the developer bearer.

6. The developing device according to claim 1, wherein the opposing member includes a plurality of ribs for heat radiation, the plurality of ribs disposed on a face of the opposing member different from the opposing face.

7. The developing device according to claim 6, wherein the opposing member is made of aluminum.

8. An image forming apparatus comprising:

the latent image bearer to bear a latent image; and the developing device according to claim 1, to develop the latent image with the developer.

9. A developing device comprising:

a developer bearer to bear developer and supply the developer to a latent image on a latent image bearer, wherein the developer includes toner and magnetic carrier;

a developer regulator disposed opposite the developer bearer, across a first gap, to regulate a layer thickness of the developer borne on the developer bearer, wherein the developer bearer includes:

a hollow developing sleeve to rotate and bear the developer; and a magnetic force generator contained inside the hollow developing sleeve not to rotate together with the hollow developing sleeve, the magnetic force generator having a plurality of magnetic poles arranged in a direction of rotation of the developer bearer, wherein the plurality of magnetic poles includes:

a regulation pole to attract the developer to a surface of the hollow developing sleeve at a position where the developer regulator regulates the layer thickness of the developer; and a post-regulation pole disposed adjacent to and downstream from the regulation pole in the direction of rotation of the developer bearer, wherein a maximum point of a magnetic force of the regulation pole in a direction normal to the surface of the hollow developing sleeve is disposed upstream from the developer regulator in the direction of rotation of the developer bearer, wherein a maximum point of a magnetic force of the post-regulation pole in the direction normal to the surface of the hollow developing sleeve is disposed downstream from the developer regulator in the direction of rotation of the developer bearer, wherein a minimum point, at which the magnetic force of each of the regulation pole and the post-regulation pole in the direction normal to the surface of the hollow developing sleeve is minimum, is disposed opposing an end of the developer regulator; and an opposing member having an opposing face disposed opposing the developer bearer across a second gap, the opposing face disposed adjacent to and upstream from the developer regulator in a direction of rotation of the developer bearer, the opposing face inclined relative to an orthogonal plane direction orthogonal to a side face of the developer regulator, the opposing face being inclined to progressively reduce a distance from the developer bearer to the opposing face in a direction of rotation of the developer bearer, wherein the first gap is narrower than the second gap, and wherein a difference between the second gap and the first gap is not greater than 1.75 times as large as the first gap.

10. The developing device according to claim 9, wherein the developer regulator includes:

a nonmagnetic plate; and a thin plate thinner than the nonmagnetic plate, the thin plate attached to the nonmagnetic plate and projecting beyond the nonmagnetic plate toward the developer bearer, the thin plate attached to an upstream-side face of the nonmagnetic plate facing an upstream side in the direction of rotation of the developer bearer.

11. The developing device according to claim 10, wherein an upstream-side edge at an end of the thin plate has a chamfered edge, the upstream-side edge facing the upstream side in the direction of rotation of the developer bearer.

12. The developing device according to claim 9, wherein the opposing member includes a plurality of ribs for heat radiation, the plurality of ribs disposed on a face of the opposing member different from the opposing face.

13. An image forming apparatus comprising:

the latent image bearer to bear a latent image; and the developing device according to claim 9, to develop the latent image with the developer.

14. The developing device according to claim 9, wherein the side face of the developer regulator opposes an upstream side in the direction of rotation of the developer bearer.

* * * * *